US005340074A

United States Patent [19]

Porcaro et al.

[11] Patent Number: 5,340,074

[45] Date of Patent: Aug. 23, 1994

[54] EYEGLASS DISPLAY HANGER

[75] Inventors: Felix A. Porcaro, Lincoln; Jeffrey A. Feibelman, East Greenwich; Daniel A. Triangolo, Cranston, all of R.I.

[73] Assignee: Accessories Associates, Inc., North Providence, R.I.

[21] Appl. No.: 168,027

[22] Filed: Dec. 15, 1993

[51] Int. Cl.[5] ..... A47F 5/00

[52] U.S. Cl. ..... 248/309.1; 211/59.1; 211/13; 248/340; 248/902

[58] Field of Search ..... 248/902, 309.1, 340, 248/317; 211/13, 59.1; 351/158; 206/5, 806

[56] References Cited

U.S. PATENT DOCUMENTS

| | | | |
|---|---|---|---|
| 3,329,386 | 7/1967 | Rosen | 248/340 |
| 3,381,806 | 5/1968 | McDonagh | 248/902 X |
| 3,891,092 | 6/1975 | Surrette | 211/13 |
| 3,895,718 | 7/1975 | Seiller | 211/13 |
| 4,239,167 | 12/1980 | Lane | 248/902 X |
| 5,000,410 | 3/1991 | Beavers | 248/902 X |
| 5,014,957 | 5/1991 | Nichol | 206/806 X |
| 5,046,696 | 9/1991 | Lee | 248/309.1 |
| 5,144,345 | 9/1992 | Nyman | 351/158 |
| 5,255,796 | 10/1993 | Josephson | 211/13 |

FOREIGN PATENT DOCUMENTS

| | | | |
|---|---|---|---|
| 2142236 | 1/1973 | France | 248/340 |

*Primary Examiner*—J. Franklin Foss
*Attorney, Agent, or Firm*—Salter & Michaelson

[57] ABSTRACT

An eyeglass display hanger permits the eyeglasses to be tried on in the normal wearing position while the hanger is still attached thereto. The eyeglass display hanger consists of a planar body which is divided into front and rear body portions by a crease line. The body further includes a slot on the crease line. The front body portion includes a first aperture which is adapted for being received over a cantilever display bar and a second aperture which is adapted for receiving the temple bar of a pair of the eyeglasses. For assembly of the hanger with a pair of eyeglasses, the front and rear body portions are folded over onto each other and the temple bar of the eyeglasses is inserted downwardly through the aperture in the front body portion and through the slot in the crease line so that the temple bar is received between the front and rear body portions. The front and rear body portions are then secured together, preferably by a self-sticking adhesive or by staples. When the temple bar is pivoted outwardly, the hanger swings outwardly with the temple bar so as not to obstruct the line of vision of the person trying the eyeglasses on.

9 Claims, 2 Drawing Sheets

EYEGLASS DISPLAY HANGER

BACKGROUND AND SUMMARY OF THE INVENTION

The instant invention relates to display hangers, and more particularly to a display hanger for eyeglasses which permits the eyeglasses to be tried on in normal wearing position while the hanger is attached thereto.

Non-prescription reading eyeglasses, or magnifiers, as they are commonly referred to, are available in various stores, such as department stores, pharmacies and other retail outlets. In contrast with prescription eyeglasses, non-prescription eyeglasses are relatively inexpensive and more easily replaced when damaged, and therefore provide a convenient and economical alternative to expensive prescription eyeglasses.

Reading eyeglasses are available in various sizes and magnifying strengths to accommodate the varying needs of individual customers. Typically, a store which sells reading glasses will display all the available styles, sizes and magnifying strengths for the customer to try on. The various eyeglasses of particular size and strength are labeled with lens stickers or other identifying means which allow the customers to differentiate between varying degrees of magnifying strengths. A customer wishing to purchase a pair of reading eyeglasses will try on several different pairs, assess the appropriate size, style and magnifying strength desired, and select the pair of eyeglasses which is best suitable for his or her needs.

Heretofore, non-prescription eyeglasses have been displayed at the point of sale in display cases having individual cubbyholes, or on vertical display stands having cantilever type arms. Typically, when the eyeglasses are displayed on the cantilever arm style display stands, the eyeglasses are provided with some type of hanger means for mounting the eyeglasses onto the cantilever arms. However, the prior art hanger means have been found to be inadequate in that they usually obstruct the customers vision when trying on the eyeglasses.

The instant invention provides an eyeglass display hanger which permits the eyeglasses to be tried on in normal wearing position while the hanger is attached thereto. The instant eyeglass display hanger comprises a planar body which is divided into front and rear body portions by a crease line. The body further includes a slot on the crease line. The front body portion includes a first aperture which is adapted for being received over a cantilever display bar and a second aperture which is adapted for receiving the temple bar of a pair of the eyeglasses. For assembly of the hanger with a pair of eyeglasses, the body is folded over along the crease line, and the temple bar of the eyeglasses is inserted downwardly through the aperture in the front body portion and through the slot in the crease line so that the temple bar is received between the front and rear body portions. The rear body portion includes a large aperture which overlaps the two apertures in the front body portion when folded over. The front and rear body portions are fixedly secured together by a pressure-sensitive adhesive coating provided on the rear surface of the rear body portion and/or staples. The front and rear surfaces of the front and rear body portions provide an increased surface area for receiving markings or other indicia, and the overlapping attachment of the body portions provides increased stability to the hanger. In use, when the temple bar is opened to the normal wearing position, the hanger swings outwardly with the temple bar so that the eyeglasses may be tried on in the normal wearing position and so that the hanger does not obstruct the vision of the person trying the eyeglasses on.

Accordingly, it is an object of the instant invention to provide an eyeglass display hanger which permits the eyeglasses to be tried on in normal wearing position while the hanger is attached thereto.

It is another object to provide an eyeglass display hanger which has increased surface area for receiving markings or other indicia thereon.

It is still another object to provide an eyeglass display hanger which is inexpensive to manufacture and easy to assemble with the eyeglasses.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DESCRIPTION OF THE PREFERRED EMBODIMENT

Figure 1:
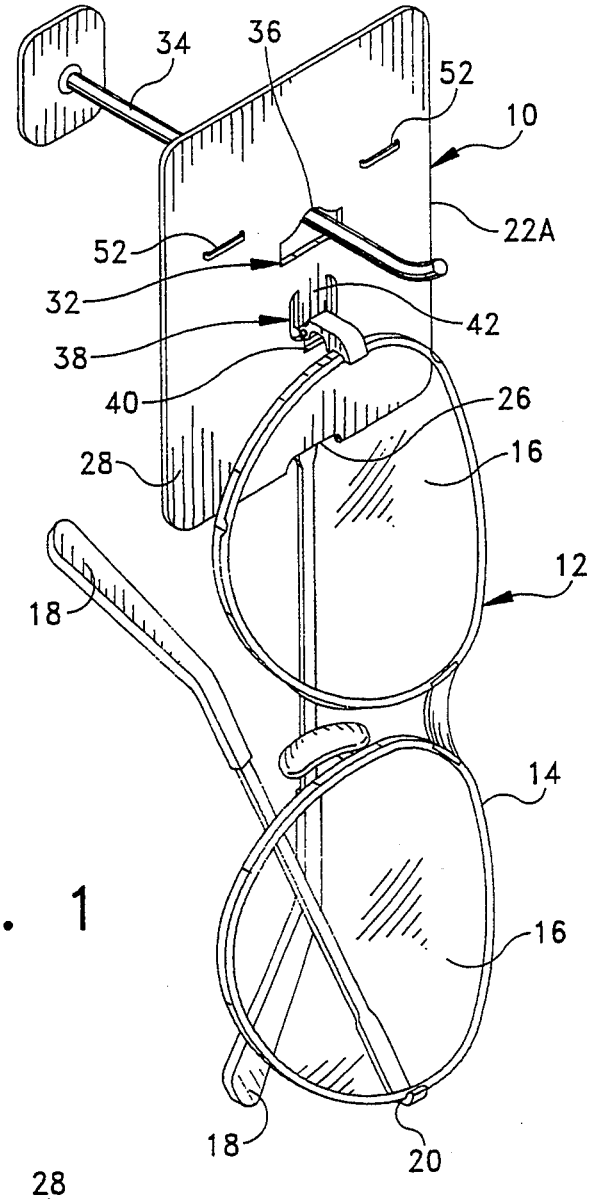
FIG. 1 is a perspective view of the instant eyeglass display hanger assembled with a pair of eyeglasses and mounted on a cantilever type display rod.

Referring now to the drawings, the eyeglass display hanger of the instant invention is illustrated and generally indicated at 10 in FIGS. 1 through 5. As will hereinafter be more fully described, the eyeglass display hanger 10 permits a pair eyeglasses generally indicated at 12 to be tried on in the normal wearing position with the hanger 10 attached thereto.

The eyeglasses 12 comprise a frame 14 having two lenses 16 mounted therein, and a pair of temple bars 18 which are connected to the opposite sides of the frame 14 by hinge connectors 20.

The eyeglass display hanger 10 comprises a substantially rectangular, planar body generally indicated at 22 (FIGS. 4 and 5) which is divided into first and second body portions 22A and 22B by a lateral crease line 24. The body 22 is preferably integrally struck from a relatively stiff paperboard material, although the body 22 may alternatively be formed from a relatively stiff, yet resilient plastic, such as polypropylene. The body 22 further includes a rectangular slot 26 which is centrally positioned along the lateral crease line 24.

The first, or front, body portion 22A includes first and second opposing surfaces 28 and 30 respectively, and a first, or hanger, aperture generally indicated at 32 which is adapted to be received on a cantilever type display bar 34 (FIG. 1). The hanger aperture 32 preferably includes an arcuate upper edge 36 which permits the hanger 10 to swing or rotate around a circular cantilever display arm 34. The first body portion 22A further includes a second, or mounting, aperture generally indicated at 38 which is adapted to receive one of the temple bars 18 of the eyeglasses 12. More specifically, the mounting aperture 38 includes a notch 40 in the lower edge thereof and a flap 42 which extends downwardly from the upper edge thereof towards the lower edge.

The second, or rear, body portion 22B includes first and second opposing surfaces 44 and 46 respectively, and a large central aperture 48 which is positioned so as to overlie both the hanger and mounting apertures 32 and 38 in the first body portion 22A when the body 22 is folded along the crease line 24. The second surface 46 (FIG. 5) of the rear body portion 22B includes a self-sticking, pressure-sensitive adhesive coating 50.

Figure 2:
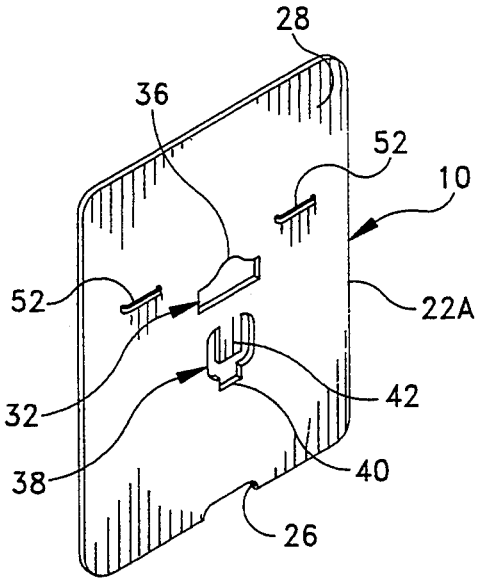
FIG. 2 is a front perspective view of the eyeglass display hanger per se.
Figure 3:
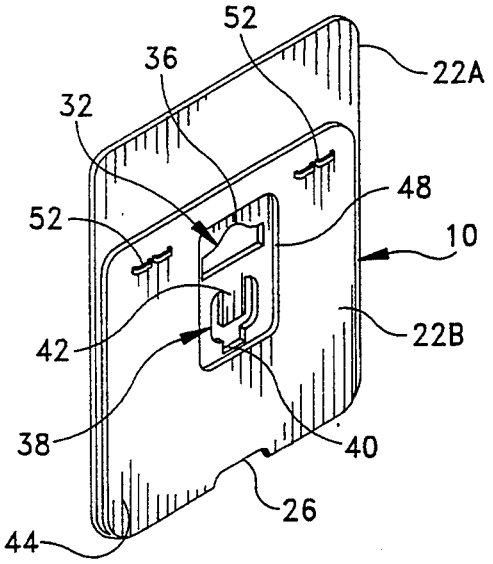
FIG. 3 is a rear perspective view thereof.
Figure 4:
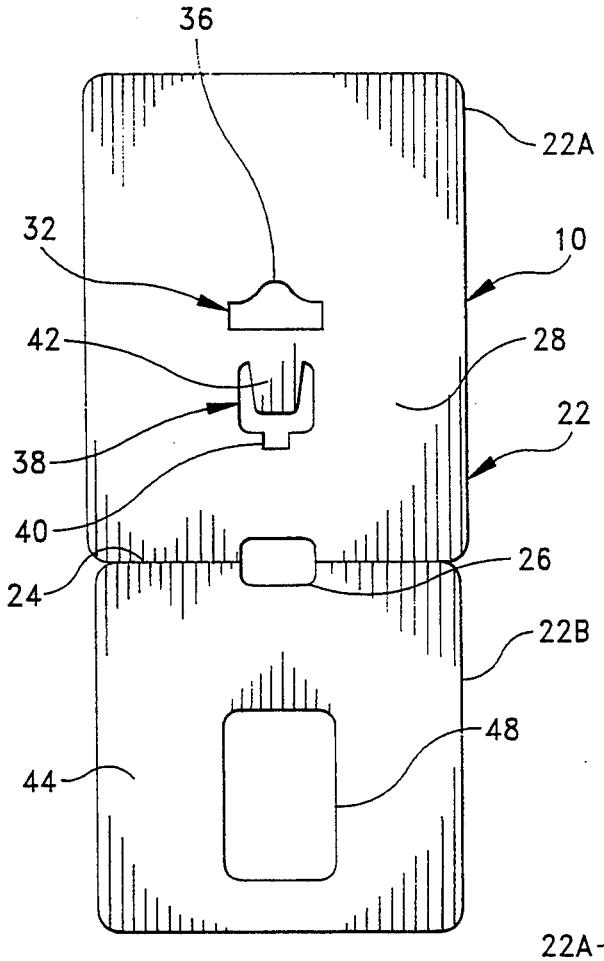
FIG. 4 is front view of the blank for forming the eyeglass display hanger.
Figure 5:
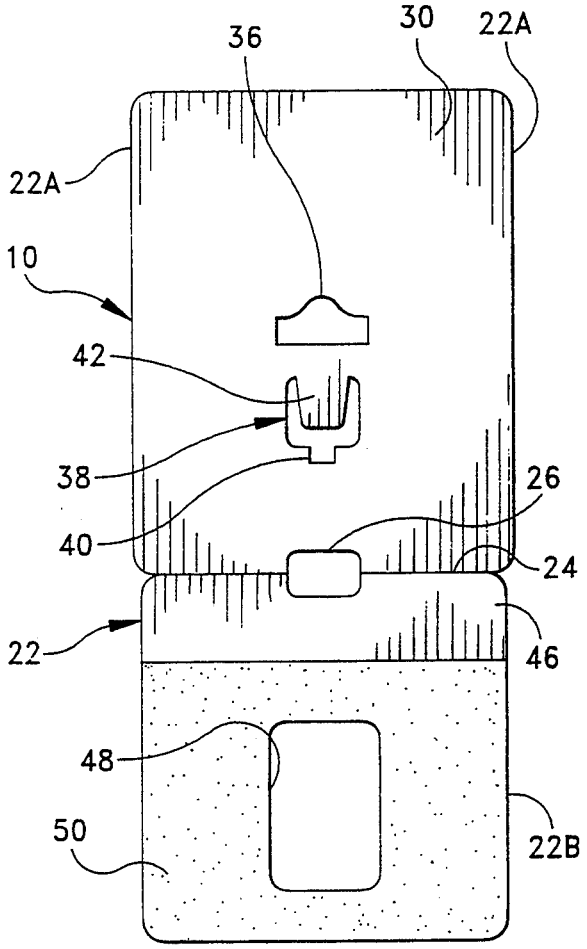
FIG. 5 is a rear view thereof.

For assembly of the hanger 10 with a pair of eyeglasses 12, the body 22 is folded along the crease line 24 so that the second surface 20 of the front body portion 22A is adjacent to the second surface 46 of the rear body portion 22B. (See FIGS. 3 and 5). One of the temple bars 18 of the eyeglasses 12 is then inserted downwardly through the mounting aperture 38 in the first body portion 22A and through slot 26 on the crease line 24 as illustrated in FIG. 1 so that the temple bar 18 is positioned adjacent to the second surface 30 of the first body portion 22A. When the temple bar 18 is fully inserted through the aperture 38 and slot 26, and then folded into the storage position (See FIG. 1), the hinge connector 20 is received within the notch 40 in the lower edge of the aperture 38. In this connection, the flap 42 extends downwardly and is operative for maintaining the hinge connector 20 in position within the notch 40. The first and second body portions 22A and 22B are thereafter pressed together and secured by the pressure-sensitive adhesive coating 50 so that the temple bar 18 is received between the body portions 22A and 22B. In order to more firmly secure the first and second body portions 22A and 22B together, one or more staples 52 may be utilized as illustrated in FIGS. 1–3. While the hanger 10 is not physically secured to the eyeglasses 12 so as to provide any anti-pilferage function, the hanger 10 nevertheless grasps the temple bar 18 firmly enough by friction so as to prevent unwanted movement of the hanger 10 while the eyeglasses 12 are being tried on. It is further pointed out that the outwardly facing surfaces of the front and rear body portions 22A and 22B provide a large surface for receiving markings or other indicia, and that the overlapping attachment of the body portions 22A and 22B provides increased stability to the hanger 10. The large aperture 48 in the second body portion 22B is positioned so that it overlies the two apertures 32 and 38 in the first body portion 22A. The aperture 48 is operative for permitting the temple bar 18 to be more easily pivoted back and forth from the normal wearing position to the folded storage position, and for permitting the cantilever display arm 34 to be extended through the hanger 10.

It can therefore be seen that the instant invention provides a novel eyeglass display hanger 10 which overcomes the disadvantages of the prior art. The instant eyeglass display hanger 10 provides increased surface area for receiving marking or other indicia while also allowing the eyeglasses 12 to be tried on in the normal wearing position while the hanger 10 is still attached thereto. When the temple bars 18 are swung open to the normal wearing position to try the eyeglasses 12 on, the hanger 10 swings outwardly with the temple bar 18 so as not to obstruct the line of vision of the person trying on the eyeglasses 12. For these reasons, the instant invention is believed to represent a significant advancement in the art which has substantial commercial merit.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

We claim:

1. An eyeglass and display hanger combination comprising:

a planar body having a lateral crease line which divides said body into first and second body portions, said planar body further having a slot on said crease line;

said first body portion having first and second opposing surfaces, and an aperture therein, said second body portion having first and second opposing surfaces, said body being folded over along said crease line so that said second surface of said second body portion is adjacent said second surface of said first body portion, a pair of eyeglasses assembled with said body, wherein a temple bar of said eyeglasses is inserted through said aperture in said first body portion and through said slot on said crease line so that said temple bar is positioned adjacent said second surface of said first body portion;

means for securing said second body portion to said first body portion so that said temple bar is received therebetween; and means for mounting said body on a cantilever display bar.

2. In the eyeglass display hanger of claim 1, said means for mounting comprising a second aperture in said first body portion which is receivable over the cantilever display bar.

3. In the eyeglass display hanger of claim 2, said second body portion further including an aperture which is positioned so as to be in alignment with said second aperture in said first body portion when said body is folded over along said crease line.

4. In the eyeglass display hanger of claim 1, said aperture in said first body portion having a notch in a lower edge thereof, and an integrally formed flap at an upper edge thereof, said flap extending downwardly toward said lower edge.

5. In the eyeglass display hanger of claim 1, said body being formed from a relatively stiff paperboard material.

6. In the eyeglass display hanger of claim 1, said means for securing said second body portion to said first body portion comprising a self-sticking, pressure-sensitive adhesive coating.

7. In the eyeglass display hanger of claim 6, said adhesive coating being applied to the second surface of said second body portion.

8. In the eyeglass display hanger of claim 1, said means for securing said second body portion to said first body portion comprising staple means.

9. In the eyeglass display hanger of claim 1, said body being formed from a relatively stiff yet resilient plastic.

* * * * *